United States Patent [19]

Kolberg

[11] Patent Number: 5,002,032

[45] Date of Patent: Mar. 26, 1991

[54] APPARATUS TO CONTROL AN INTERNAL COMBUSTION ENGINE IN VEHICLES

[75] Inventor: Gerhard Kolberg, Buehl-Weitenung, Fed. Rep. of Germany

[73] Assignee: Robert Bosch GmbH, Stuttgart, Fed. Rep. of Germany

[21] Appl. No.: 334,427

[22] Filed: Apr. 7, 1989

[30] Foreign Application Priority Data

Apr. 9, 1988 [DE] Fed. Rep. of Germany ..... 3811892

[51] Int. Cl.[5] ..... F02D 9/02; F02D 41/22; F02D 11/04

[52] U.S. Cl. ..... 123/399; 123/361

[58] Field of Search ..... 123/340, 361, 399, 479

[56] References Cited

U.S. PATENT DOCUMENTS

| | | | |
|---|---|---|---|
| 4,530,326 | 7/1985 | Mann et al. | 123/342 |
| 4,785,691 | 11/1988 | Papenhagen et al. | 74/877 |
| 4,856,477 | 8/1989 | Hanaoka et al. | 123/399 |

FOREIGN PATENT DOCUMENTS

| | | | |
|---|---|---|---|
| 306640 | 3/1989 | European Pat. Off. | 123/399 |
| 122742 | 7/1984 | Japan | 123/399 |
| 153945 | 9/1984 | Japan | 123/361 |
| 3239 | 1/1989 | Japan | 123/399 |
| 87836 | 3/1989 | Japan | 123/399 |

*Primary Examiner*—Tony M. Argenbright
*Attorney, Agent, or Firm*—Edwin E. Greigg

[57] ABSTRACT

An apparatus to control an internal combustion engine in vehicles, containing a set point value transducer which is adjustable by means of a drive lever, a control motor driving a throttle valve, and control electronics which use the output signals from the set point value transducer to generate a control signal for the control motor. In order to maintain emergency operation in the event of a failure of the electric controls, an emergency operation system directly transmits the drive lever or gas pedal position to the throttle valve. To insure the engagement of the emergency operation system in the event of problem on the one hand, and to prevent additional friction being exerted on the control motor during normal operation on the other, the emergency operation system contains a coupling whose one coupling element is firmly fixed to the throttle valve and whose other coupling element is permanently attached to the drive lever. The coupling is comprised such that the two coupling elements do not mesh during normal operation, and automatically mesh if a problem arises.

29 Claims, 4 Drawing Sheets

APPARATUS TO CONTROL AN INTERNAL COMBUSTION ENGINE IN VEHICLES

BACKGROUND OF THE INVENTION

The invention concerns improvements in an apparatus to control an internal combustion engine in a motor vehicle.

Such an apparatus electronically controls the power of the internal combustion engine by changing the throttle valve setting. The control electronics are envisioned in such a fashion that, should major problems arise, they can be switched off and the internal combustion engine can be brought to a standstill by the pressure from a restoring spring which closes the throttle valve. The maneuverability of the vehicle under these circumstances is guaranteed by the presence of an additional emergency operation system.

In known apparatus of this type, (DE-PS 36 09 849) the drive lever or drive pedal is connected by a Bowden cable to a set point value transducer which it adjusts depending on the drive lever position. The position of the set point value transducer is transmitted in the form of an electric signal to control electronics, which use it along with other control parameters such as the drive wheel slippage to generate a set point signal for the control motor that pivots the throttle valve.

The emergency operation system comprises a mechanical transmission element in the form of a rod, whose length can be changed, and which can be connected to the set point value transducer by means of a connecting lever. By means of a drag lever, the connecting lever can be pulled in the direction of full load. The drag lever connects the drive lever to the set point value transducer. The change in the length of the rod is performed by means of two compression springs of different initial tension. In case of a breakdown where the electric power control fails, engaging the drive lever with a powerless control motor will result in the connecting lever being pulled along by the drag lever to such an extent that the transmission rod is compressed to a point where the throttle valve is closed by the strength of the stronger compression spring. When this occurs, the vehicle can be driven with the internal combustion engine operating at half load.

The disadvantage here lies in the fact that, during normal operation, for instance while regulating slippage, the control motor must work against the pressure applied by the weaker compression spring on the transmission rod, thus producing an additional resistance due to friction. Generally available control motors, with their great sensitivity to torque changes, cannot therefore be used.

OBJECT AND SUMMARY OF THE INVENTION

It is a principal object of the invention to provide an improved control device having the advantage that, during normal operation, the drive lever is completely disconnected from the throttle valve, so that the torque-sensitive control motor connected to the throttle valve axle is not subjected to any additional friction. Only when a problem arises, in other words, when the control motor is turned off, will the drive lever be coupled to the throttle valve, independently and without any action by the driver, and the throttle valve will be mechanically adjusted by the drive lever when the drive lever is engaged in emergency operation.

It is another object that by designing the coupling in the form of an electromagnetic connection, the automatic interlock between the throttle valve and the drive lever can be particularly well attained because, should the power to the control motor fail, the coupling magnet will also lose power and the connection between the two coupling elements, which is left open while the magnet is receiving power, is automatically reestablished by a coupling spring. If the electromagnet and the control motor are connected in series, no special output end stage is required in order to have the control electronics turn the electromagnet on.

It is still another object to provide that if the opposing end faces of the coupling elements are fitted with axially emerging claws to take up torque from both coupling elements, and a certain amount of play in the direction of the torque is permitted when the opposing claws mesh, the power output of the internal combustion engine during emergency operation can be limited compared to the output during normal operation.

The coupling of the throttle valve and the drive lever in accordance with the invention and the respective fixed connection of the one coupling element with the throttle valve and the other coupling element with the drive levers, allows the set point value transducer to be built into the throttle valve/control motor/electronic control unit—the so-called throttle valve setter—itself, if, in accordance with the invention, the set point value transducer is installed on the coupling element coupled to the drive lever. An electric actual value transducer which can determine the position of the throttle valve should be installed on either the first coupling element coupled to the throttle valve shaft, or on the throttle valve shaft itself. With this, the set point value transducer and the actual value transducer can be combined into a single unit. If the set point value transducer and the actual value transducer are to be constructed as rotary angle transducers, for instance as rotary angle potentiometers, the sliding drag paths of the two potentiometers are disposed on a fixed insulating plate, while the wipers in contact with each path are each coupled to a respective coupling element in a manner fixed against relative rotation. The insulating plate is disposed coaxially with the throttle valve shaft.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
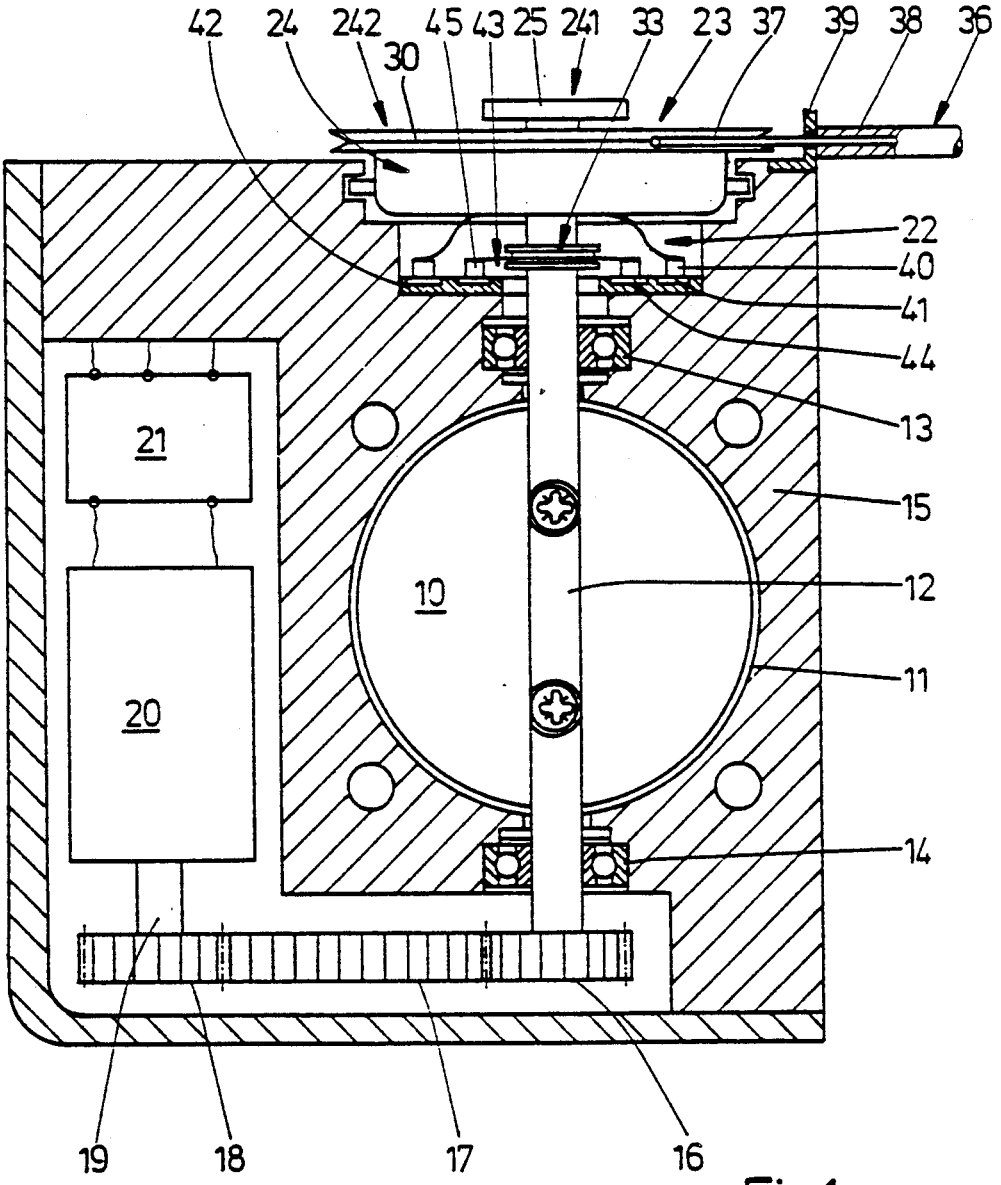
FIG. 1 shows a cross-section of the throttle valve setter.

The throttle valve setter shown in schematic cross-section in FIG. 1 is used to control the internal combustion engine in a vehicle by, depending on the position of the drive lever or drive pedal (not shown), pivoting a throttle valve 10 in the intake channel 11 of an internal combustion engine in such a manner as to produce a certain opening cross-section, and thus to determine the amount of mixture supplied to the engine and, therefore, the power output of the engine. The throttle valve 10 is mounted in a manner fixed against relative rotation on a throttle valve shaft 12 which is held in bearings 13, 14 in a housing 15 of the throttle valve setter. A gear 16 is mounted on the throttle valve shaft 12 and is driven via a toothed belt 17 by a gear wheel 18 on the drive shaft 19 of a directionally reversible, electronically controlled motor, known hereafter as the control motor 20. The control motor 20 is controlled by control electronics 21, which convert the electric output signal from a set point value transducer 22 (to be described below), along with other set values such as the slippage of the drive wheels, into a control voltage for the control motor 20. The electrical output signal of the set point value transducer 22 is a direct standard for the position of the drive pedal or drive lever. If depressing the drive lever is meant to increase the speed of the internal combustion engine, the set point value transducer 22 is repositioned by the drive lever. The control electronics 21 use the output signal of the set point value transducer 22 to produce a control voltage for the control motor 20, which turns the throttle valve 12 by a certain rotary angle. The control electronics 21 are conceived in such a manner that, when a major problem arises, the control motor 20 is switched off and the throttle valve 10 is returned to its closed position by a restoring spring, not shown (see FIG. 1). If the mixture feed is interrupted, the engine stops. In order to insure a certain maneuverability of the vehicle, an emergency operation system 23 is envisioned which would mechanically connect the drive lever directly to the throttle valve shaft 12 in such an event, thus transmitting the pivoting of the drive lever directly to the throttle valve 10.

More specifically, the emergency operation system 23 has an electromagnetic coupling 24, whose first coupling element 241 is firmly fixed to the valve shaft 12, and whose second coupling element 242 is permanently attached to the drive lever. The coupling 24 is embodied such that the two coupling elements 241, 242 are not in contact during normal operation with uninterrupted power supply, and automatically come into contact during any power outage, with the attendant shutoff of the control motor 20, during such an occurrence.

Figure 2:
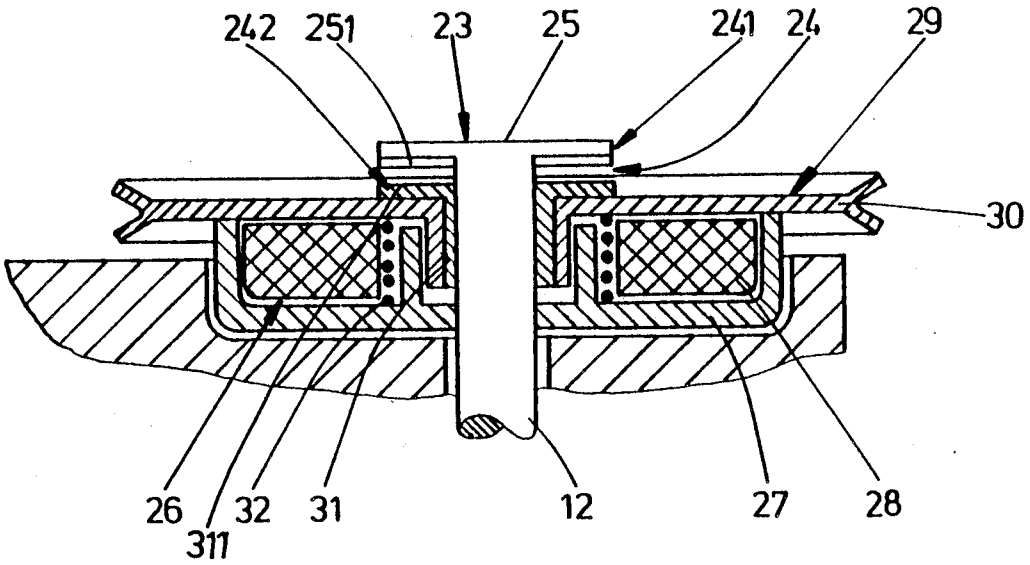
FIG. 2 shows an enlarged, lengthwise cross-section of an electromagnetic coupling in the throttle valve setter of FIG. 1.

As is more clearly shown in FIG. 2, the first coupling element 241 is formed by an end flange 25 set on the end of the throttle valve shaft 12. The second coupling element 242, which is spaced apart from the end flange 25 and concentrically surrounds the throttle valve shaft 12, is pivotably mounted in the housing 15 of the throttle valve setter, but protected against axial displacement within the housing 15 (see FIG. 1). The second coupling element 242 contains the electromagnet 26 with its cup-shaped check yoke 27, cylindrical excitation winding 28 and the armature 29 covering the cup opening. The armature 29 is formed as a pulley 30, which is mounted in a manner fixed against relative rotation on a sleeve 31, whose cross-section is T-shaped. The sleeve 31 can freely turn and is axially displaceable on the throttle valve shaft 12. Inside the cup-shaped check yoke 27 there is a coupling spring 32 embodied as a compression spring, which is supported on the pulley 30 on one end and on the check yoke 27 on the other, and attempts to displace the sleeve 31 via the pulley 30 counter to the magnetic force of the electromagnet 26. With the electromagnet 26 switched off, the sleeve 31 and the pulley 30 are displaced so far along the throttle valve shaft 12 that the opposing end faces 311 of the sleeve 31 and 251 of the end face 25 come into contact.

Figure 3:
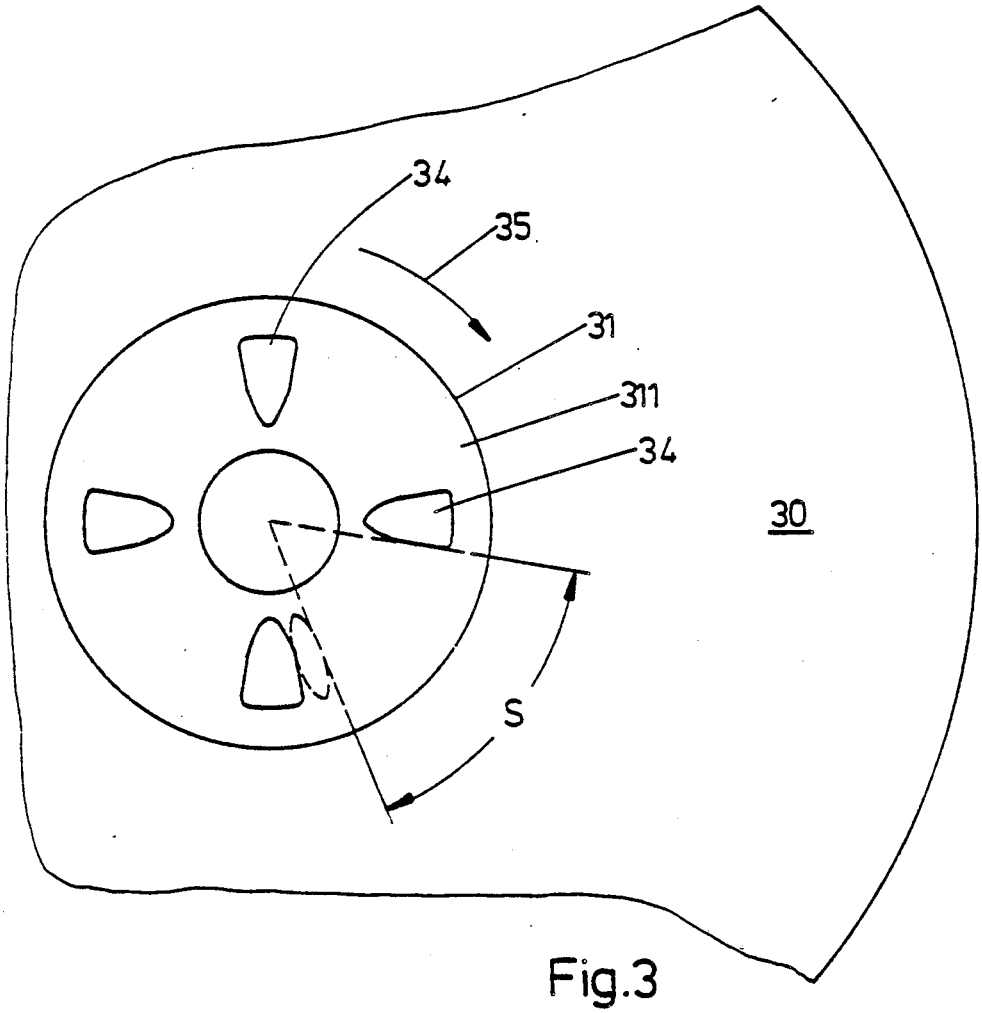
FIG. 3 and 4 each show a plan view of the opposing coupling parts in the coupling of FIG. 2.
Figure 4:
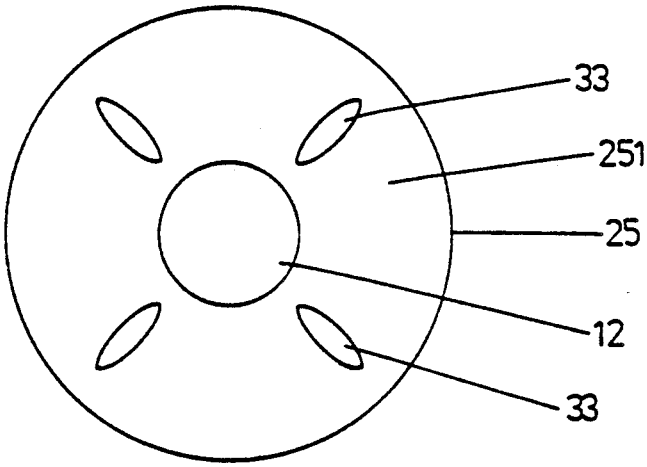

As shown in FIGS. 3 and 4, both the end face 251 and the end face 252 are equipped with axially protruding cams 33 and 34, which are evenly distributed around the circumference of the end faces 251 and 311. Each end face 251 and 311 is equipped with four cams 33 and 34 which are offset by 90° angles from one another around the circumference. The dimensions of the cams 33, 34 in the circumferential direction are relatively small, so that with the cams 33, 34 meshed, the end face 25 and the sleeve 31 can turn along a rotational path S without causing the other element to be subject to torque (see FIG. 3). This play of the coupling 24, denoted by the symbol S, is used to reduce the output power of the engine during emergency operation.

As can be seen in FIG. 1, a Bowden cable 36 tangentially engages the pulley 30. The cord 37 of the Bowden cable 36 is attached to the pulley 30, while the face of the sleeve 38 of the Bowden cable 36 is supported by a stop angle 39 on the housing 15. The Bowden cable 36 directly connects the pulley 30 to the drive lever, so that each pivoting of the drive lever produces a corresponding rotation of the pulley 30. The electrical connections for the excitation winding 28 schematically shown in FIG. 2 are switched parallel to the connections for the control motor 20.

The set point value transducer 22 schematically shown in FIG. 1 is in the form of a rotary angle potentiometer, in which a wiper 40 is in contact with a ring-shaped drag path 41 and from which, depending on the rotational position of the wiper 40, a corresponding output voltage can be tapped from either the drag path 41 and/or the wiper 40. The drag path 41 is disposed as the outer orbit on an insulating plate 42, which concentrically surrounds the throttle valve shaft 12 and is secured in the housing 15. The wiper 40—here in the shape of a dual wiper—is attached to the check yoke 27 and moves in accordance with its rotational motion along the drag path 41. Another actual value transducer 43, which determines the rotational position of the throttle valve 10, is connected to the throttle valve 10. The electrical output signal of the actual value transducer 43 is a measure of the pivoted position of the throttle valve 10, and is also fed to the control electronics 21. Like the set point value transducer 22, the actual value transducer 43 is also in the form of a rotary angle potentiometer whose drag path 44 is positioned concentrically to the drag path 41 on the insulating plate 42. The wiper 45 of the actual value transducer 43 is connected to the throttle valve shaft 12 in a manner fixed against relative rotation.

The operation of the above-described throttle valve setter to control the power output of an internal combustion engine is as follows:

With the engine idling, that is, with the drive lever not engaged, the control electronics 21 send a specific control signal to the control motor 20, which opens the throttle valve 10 far enough to allow the engine to idle. When the control motor 20 receives power, the excitation winding 28 of the electromagnetic coupling 24 also receives power. The resulting magnetic field axially displaces the pulley 30 counter to the force of the coupling spring 32 until it is in contact with the end face of the check yoke 27. The displacement of the pulley 32 disengages the cams 33, 34. The coupling 24 disengages, and the pulley 30 and throttle valve shaft 12 can rotate independently of one another.

If the vehicle is to accelerate, the driver will depress the drive lever. The pivoting motion of the drive lever is converted by the Bowden cable 36 into a pivoting motion of the pulley 30, and, since it is in contact with the check yoke 27, into a pivoting motion of the entire coupling element 242. This pivoting motion causes the brush 40 of the set point value position transducer 22 to rotate on the drag path 41, which increases the electrical output signal of the set point value transducer 22. The larger output signal from the set point value transducer 22 fed to the control electronics 21 triggers the delivery of a corresponding control signal to the control motor 20, which via the toothed belt drive 16–18 pivots the throttle valve shaft 12, so that the flow opening in the intake channel 11 that is uncovered by the throttle valve increases in size.

If a major problem arises in the electric control, the control electronics 21 switch the control motor 20 off, and the throttle valve 10 is rotated by the restoring spring back into its closed position (FIG. 1). This completely closes the flow opening in the intake channel 11, and the engine stops because of the lack of fuel mixture. When the control motor 20 is switched off, power is also removed from the excitation winding 28 of the electromagnet 26, and the coupling spring 32 displaces the pulley 30 with the sleeve 31 axially towards the outside until the cams 33, 34 of the end flange 25 and sleeve 31 rest axially against the end faces 311 and 251 and engage one another. If the drive lever is now engaged, the pulley 30 is again pivoted by the Bowden cable 36 in the direction of the arrow 35 in FIG. 3. After the pivoting path or the play S has been completed, the cams 34 on the end face 311 of the sleeve 1 make contact with the cams 33 on the end face 251 of the end flange 25 and carry them in the direction of rotation. This turns the throttle valve shaft 12 and pivots the throttle valve 10 into a position which again produces a specific opening in the intake channel 11. The engine again receives fuel mixture, and the vehicle can be operated in a sort of emergency mode. The play S between the cams 33 and 34 reduces the power output of the engine when the drive lever is completely engaged.

Figure 5:
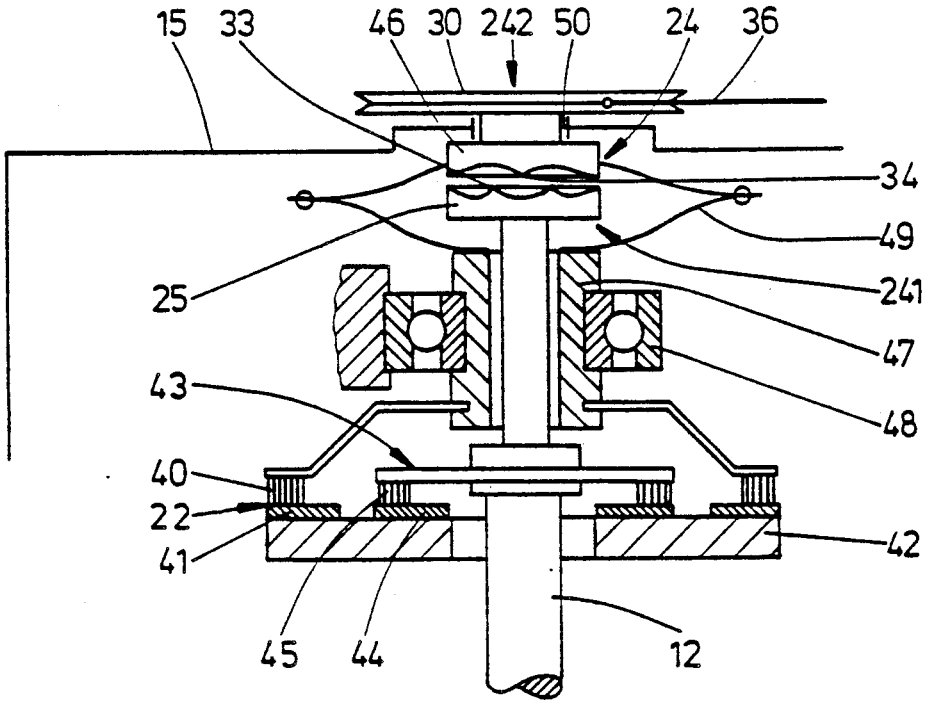
FIG. 5 shows a side view of a set point value transducer and an actual value transducer in a fragmentary view of a throttle valve setter in accordance with a further embodiment.

In the throttle valve setter shown in part in FIG. 5, the construction of the electromagnetic coupling 24 and the set point value transducer 22 are slightly modified, which, however, produces a somewhat larger axial construction length. The second coupling element 242 no longer surrounds the throttle valve shaft 12 but is instead held rotatably in the housing 15 in a bearing schematically shown at 50 in an extension of the throttle valve shaft 12. Of the second coupling element 242, only the pulley 30 is shown, and it is connected, in a manner fixed against relative rotation, to an end flange 46 lying opposite the end flange 25 and equipped in the same manner with axially protruding cams 34 like those in sleeve 31 in FIG. 2, which can be made to mesh with the cams 33 on the end flange 25. The electromagnet 26 is not pictured here. The set point value transducer 22 and actual value transducer 43 are again in the form of rotary angle potentiometers and are disposed in the same way as in FIG. 1. The two drag paths 41 and 44 are concentrically arranged on the insulating plate 42, which is disposed coaxially with the throttle valve shaft 12, and the wiper 45 of the actual value transducer 43 is again in the form of a dual wiper attached to the throttle valve shaft 12. The wiper 40 of the set point value transducer 22 is in the form of a dual wiper and attached to a sleeve 47 which lies coaxially to the throttle valve shaft 12, surrounds it, and is rotatably held in a bearing 48 in the housing 15. The sleeve 47 is connected in a manner fixed against relative rotation with the end flange 46 of the second coupling element 242 by a coupled drive element 49. The operation of the throttle valve modified in this way is identical to that previously described. Since the rotary angle of the rotary angle potentiometers is less than 180°, the drag paths of the set point value transducer 22 and the actual value transducer 43 can be laid out as circular segments on the same ring extending coaxially to the throttle valve shaft 12. As before, the wipers remain respectively attached to the throttle valve shaft 12 and the sleeve 47, but are now only single wipers.

To supply both the excitation winding 28 of the coupling 24 and the control motor 20 with power, the former should either be connected in series with the control motor 20 or connected in parallel directly to the motor's terminals so that an electric safety shut-off in the control electronics 21 for the control motor 20 will also cut the power supply to the excitation winding 28 if a problem arises.

The foregoing relates to preferred exemplary embodiments of the invention, it being understood that other variants and embodiments thereof are possible within the spirit and scope of the invention, the latter being defined by the appended claims.

What is claimed and desired to be secured by patent of the U.S. is:

1. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of said control electronics, said emergency operation system (23) having a coupling means (24) including a first coupling element (241) including an end flange (25), mounted on an extremity of and firmly fixed to a throttle drive shaft (12) of the throttle valve (10) and a second coupling element (242) rotatably mounted on and pivotably disposed relative to the throttle drive shaft and permanently attached to a drive means connected to the drive lever and facing said first coupling element (241), and the coupling means (24) is comprised such that said first and second coupling elements (241, 242) remain disengaged during normal operation and automatically engage one another should a disruption of said control electronics occur.

2. An apparatus as defined by claim 1, further wherein the second coupling element (242) contains an electromagnet (26) disposed in a check yoke (27), an excitation winding (28) and an armature (29), and the armature (29) is connected to the drive means.

3. An apparatus as defined by claim 2, further wherein the armature (29) is under pressure from a coupling spring (32) whose spring force is directed counter to a magnetic field generated by the electromagnet (26) and acting in the axial direction of the throttle valve shaft (12).

4. An apparatus as defined by claim 3, further wherein the armature (29) is disposed in an axially spaced opposed relation to the end flange (25), and opposing surfaces (251, 311) of the end flange (25) and the armature (29) have cams (33, 34) evenly radially distributed about such opposing surfaces, allowing for coupled rotation of the end flange (25) and the armature (29) when the coupling (24) is operative.

5. An apparatus as defined by claim 4, further wherein the cams (33, 34) of the end flange (25) and the armature (29) mesh with play in a direction of rotation thereof when the coupling (24) is operative.

6. An apparatus as defined by claim 2, further wherein the armature (29) comprises pulley (30) connected to the drive lever by a Bowden cable (36) engaging said pulley substantially tangentially.

7. An apparatus as defined by claim 2, further wherein the excitation winding (28) of the electromagnet (26) is electrically connected to the electric motor (20) so that upon any interruption of the control circuit the control electronics (21) will cut power to the electric motor (20), and thus as well to the electromagnet.

8. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of the electric control signals for said control element, said emergency operation system (23) having a coupling means (24) including a first coupling element (241) firmly fixed to a throttle drive shaft (12) of the throttle valve (10) and a second coupling element (242) disposed pivotably relative to the throttle drive shaft, permanently attached to a drive means connected to the drive lever and facing said first coupling element (241), said second coupling element (242) contains an electromagnet (26) disposed in a check yoke (27), an excitation winding (28) and an armature (29), and the armature (29) is connected to the drive means; when the electromagnet (26) is excited, the armature (29) rests on the check yoke (27) and a coupling spring (32) is supported at one end on the armature (29) and on the other end on the check yoke (27), and the coupling means (24) is comprised such that the first and second coupling element (241, 242) remain disengaged during normal operation and automatically engage one another should a disruption of the electric control signals for said control element occur.

9. An apparatus as defined by claim 8, further wherein the armature (29) is under pressure from a coupling spring (32) whose spring force is directed counter to a magnetic field generated by the electromagnet (26) and acting in the axial direction of the throttle valve shaft (12).

10. An apparatus as defined by claim 9, further wherein the armature (29) is disposed in an axially spaced opposed relation to an end flange (25), and opposing surfaces (251, 311) of the end flange (25) and the armature (29) have cams (33, 34) evenly radially distributed about such opposing surfaces, allowing for coupled rotation of the end flange (25) and the armature (29) when the coupling (24) is operative.

11. An apparatus as defined by claim 10, further wherein the cams (33, 34) of the end flange (25) and the armature (29) mesh with play in a direction of rotation thereof when the coupling (24) is operative.

12. An apparatus as defined by claim 8, further wherein the armature (29) comprises a pulley (30) connected to the drive lever by a Bowden cable (36) engaging said pulley substantially tangentially.

13. An apparatus as defined by claim 8, further wherein the excitation winding (28) of the electromagnet (26) is electrically connected to the electric motor (20) so that upon any interruption of the control circuit the control electronics (21) will cut power to the electric motor (20), and thus as well to the electromagnet.

14. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of the electric control signals for said control element, said emergency operation system (23) having a coupling means (24) including a first coupling element (241) firmly fixed to a throttle drive shaft (12) of the throttle valve (10) by an end flange (25) mounted on an extremity of the throttle valve shaft (12) and a second coupling element (242) disposed relative to the throttle drive shaft, permanently attached to a drive means connected to the drive lever facing said first coupling element (241), said second coupling element (242) contains an electromagnet (26) disposed in a check yoke (27), an excitation winding (28) and an armature (29), and the armature (29) is connected to the drive means; when the electromagnet (26) is excited, the armature (29) rests on the check yoke (27) and a coupling spring (32) is supported at one end on the armature (29) and on the other end on the check yoke (27), and the coupling means (24) is comprised such that the first and second coupling elements (241, 242) remain disengaged during normal operation and automatically engage one another should a disruption of the electric control signals for said control element occur.

15. An apparatus as defined by claim 14, further wherein the armature (29) is under pressure from a coupling spring (32) whose spring force is directed counter to a magnetic field generated by the electromagnet (26) and acting in an axial direction of the throttle valve shaft (12).

16. An apparatus as defined by claim 15, further wherein the armature (29) is disposed in an axially spaced opposed relation to the end flange (25), and opposing surfaces (251, 311) of the end flange (25) and the armature (29) have cams (33, 34) evenly radially distributed about such opposing surfaces, allowing for coupled rotation of the end flange (25) and the armature (29) when the coupling (24) is operative.

17. An apparatus as defined by claim 16, further wherein the cams (33, 34) of the end flange (25) and the armature (29) mesh with play in a direction of rotation thereof when the coupling (24) is operative.

18. An apparatus as defined by claim 14, further wherein the armature (29) comprises a pulley (30) connected to the drive lever by a Bowden cable (36) engaging said pulley substantially tangentially.

19. An apparatus as defined by claim 14, further wherein the excitation winding (28) of the electromagnet (26) is electrically connected to the electric motor (20) so that upon any interruption of the control circuit the control electronics (21) will cut power to the electric motor (20), and thus as well to the electromagnet.

20. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of said control electronics, said emergency operation system (23) having a coupling means (24) including a first coupling element (241) which is fixed to a throttle drive shaft of the throttle valve (10) and a second coupling element (242) rotatably mounted on and pivotably disposed relative to the throttle drive shaft and permanently attached to a drive means connected to the drive lever, said second coupling element (242) contains an electromagnet (26) disposed in a check yoke (27), an excitation winding (28) and an armature (29) disposed in an axially spaced opposed relation to an end flange (25), and opposing surfaces (251, 311) of the end flange (25) and the armature (29) have cams (33, 34) evenly radially distributed about such opposing surfaces, said cams (33, 34) of the end flange (25) and the armature (29) mesh with play in a direction of rotation allowing for coupled rotation of the end flange (25) and the armature (29) when the coupling (24) is operative, the armature (29) is connected to the drive means under pressure from a coupling spring (32) whose spring force is directed counter to a magnetic field generated by the electromagnet (26) and acting in an axial direction of the throttle valve shaft (12), and the coupling means (24) is comprised such that the first and second coupling elements (241, 242) remain disengaged during normal operation and automatically engage one another should said disruption of the control electronics occur.

21. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of the electric control signals for said control element, said emergency operation system (23) having a coupling means (24) including a first coupling element (241) which is fixed to a throttle drive shaft (12) of the throttle valve (10) by an end flange (25) mounted on an extremity thereof and a second coupling element (242) rotatably mounted on and pivotably disposed relative to the throttle drive shaft and permanently attached to a drive means connected to the drive lever and held at an axial distance from the end flange (25) in a stationary bearing (50), said second coupling element (242) contains an electromagnet (26) disposed in a check yoke (27), an excitation winding (28) and an armature (29), and the armature (29) is connected to the drive means under pressure from a coupling spring (32) whose spring force is directed counter to a magnetic field generated by the electromagnet (26) and acting in an axial direction of the throttle valve shaft (12), said armature (29) is disposed in an axially spaced opposed relation to the end flange (25), and opposing surfaces (251, 311) of the end flange (25) and the armature (29) have cams (33, 34) evenly radially distributed about such opposing surfaces, said cams (33, 34) of the end flange (25) and the armature (29 mesh with play in a direction of rotation thereof allowing for coupled rotation of the end flange (25) and the armature (29) when the coupling (24) is operative, and the coupling means (24) is comprised such that the first and second coupling elements (241, 242) remain disengaged during normal operation and automatically engage one another should said disruption of the control electronics occur.

22. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of said control electronics, said emergency operation system (23) having a coupling means (24) including a first coupling element (241) which is fixed to a throttle drive shaft of the throttle valve (10) and a second coupling element (242) rotatably mounted on and pivotably disposed relative to the throttle drive shaft and permanently attached to a drive means connected to the drive lever, said second coupling element (242) contains an electromagnet (265) disposed in a check yoke (27) an excitation winding (28) and an armature (29), said armature (29) is connected to the drive lever means and the armature (29) comprises a pulley (30) connected to the drive lever by a Bowden cable (36) engaging said pulley substantially tangentially, and the coupling means (24) is comprised such that the first and second coupling elements (241, 242) remain disengaged during normal operation and automatically engage one another should said disruption of the control electronics occur.

23. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of said control electronics, said emergency operation system (23) having a coupling means (24) including a first coupling element (241) which is fixed to a throttle drive shaft fixed to the throttle valve (10) by an end flange (25) mounted on an extremity thereof and a second coupling element (242) rotatably mounted on and pivotably disposed relative to the throttle drive shaft and permanently attached to a drive means connected to the drive lever, said second coupling element (242) contains an electromagnet (26) disposed in a check yoke (27), an excitation winding (28) and an armature (29) connected to the drive means and the armature (29) comprises a pulley (30) connected to the drive lever by a Bowden cable (36) engaging said pulley substantially tangentially, and the coupling means (24) is comprised such that the first and second coupling elements (241, 242) remain disengaged during normal operation and automatically engage one another should said disruption of the control electronics occur.

24. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of said control electronics, said emergency operation system (23) having a coupling means (24) including a first coupling element (241) which is fixed to a throttle drive shaft of the throttle valve (10) and a second coupling element (242) rotatably mounted on and pivotably disposed relative to the throttle drive shaft and permanently attached to the drive lever, said set point value transducer is disposed on said second coupling element (242), and the coupling means (24) is comprised such that said first and second coupling elements (241, 242) remain disengaged during normal operation and automatically engage one another should a disruption of said control electronics occur.

25. An apparatus as defined by claim 24, further including an actual value transducer wherein the set point value transducer (22) and the actual value transducer (43) comprise first and second rotary angle transducers, respectively, whose stationary components (41, 44) are disposed on a common structural component (42).

26. An apparatus as defined by claim 25, further wherein the first and second rotary angle transducers comprise rotary angle potentiometers having respective drag paths (41, 44) disposed on said common structural component, and said component comprises a fixed, insulating plate (42) and said first and second rotary angle transducers include respective wipers (40, 45), one of said wipers being connected o one coupling element and the other of said wipers being connected to the other coupling element.

27. An apparatus as defined by claim 25, further wherein the first and second rotary angle transducers comprise rotary angle potentiometers having respective drag paths (41, 44) disposed on said common structural component, and said component comprises a fixed, insulating plate (42) and said first and second rotary angle transducers include respective wipers (40, 45) one of said wipers being connected to one coupling element and the other of said wipers being connected to the throttle valve shaft (12).

28. An apparatus as defined by claim 26, further wherein the drag paths (41, 44) are disposed on the insulating plate (42) to surround the throttle valve shaft (12) coaxially, the wiper (44) of the actual value transducer (43) is fixed against rotation relative to the throttle valve shaft (12); the wiper (40) of the set point value transducer (22) is connected in a manner fixed against rotation relative to a sleeve (47) provided surrounding the throttle valve shaft (12), said sleeve being disposed radially with play and rotatably held in a stationary bearing (48); and the sleeve (47) is rigidly connected to the second connecting element (242).

29. An apparatus to control an internal combustion engine in vehicles, having a set point value transducer adapted to be varied from an idling to a full-load position via a drive lever for generating electrical set point value signals corresponding to a position of the drive lever; a control element comprising an electric motor for driving a throttle valve disposed in an intake channel of the engine; control electronics for generating control signals for the control element in accordance with at least the electrical set point value signals received from said set point value transducer, further having an emergency operation system to couple the drive lever position to the throttle valve during a disruption of the electric control signals for said control element, said emergency operation system (23) having a coupling means (24) including a first coupling element (241) firmly fixed to a throttle drive shaft (12) of the throttle valve (10) and a second coupling element (242) disposed pivotably relative to the throttle drive shaft and permanently attached to a drive means connected to the drive lever and facing said first coupling element (241), an electric actual value transducer (42) that electrically detects a position of the throttle valve (10 is connected to the first coupling element (241), and its output signal is supplied to the control electronics (21), and the coupling means (24) is comprised such that the first and second coupling elements (241, 242) remain disengaged during normal operation and automatically engage one another should a disruption of the electric control signals for said control element occur.

* * * * *